US006003464A

United States Patent [19]

Long

[11] Patent Number: 6,003,464

[45] Date of Patent: Dec. 21, 1999

[54] FLOATABLE SYSTEM UTILIZING STRUCTURAL DECK PLATES

[76] Inventor: Loren L. Long, 2067 Quail Canyon Ct., Hayward, Calif. 94542

[21] Appl. No.: 09/158,228

[22] Filed: Sep. 22, 1998

[51] Int. Cl.[6] ..... B63B 35/44

[52] U.S. Cl. ..... 114/263

[58] Field of Search ..... 114/263, 264, 114/265, 258; 441/35

[56] References Cited

U.S. PATENT DOCUMENTS

| | | | |
|---|---|---|---|
| 3,329,117 | 7/1967 | Meeusen | 114/263 |
| 4,979,453 | 12/1990 | Sloan et al. | 114/263 |
| 5,390,620 | 2/1995 | Murphy et al. | 114/263 |
| 5,526,763 | 6/1996 | Liaw | 441/35 |

*Primary Examiner*—Stephen Avila
*Attorney, Agent, or Firm*—L. E. Carnahan

[57] ABSTRACT

A floating dock and raft system utilizing a non-skid structural surface or deck plate walking surface, without substructure, and which is attached directly to all other components of the dock system such as floats, hinges, splice plates, gangways, etc. A U-shaped rub rail is attached to the edge of the surface plate. The dock surface or deck plate is supported by floats which are attached to the surface plate by bolts or by adhesive materials. The deck plate has the strength and stiffness to meet accepted design standards for docks, which includes the capability of resisting tear-out of fasteners used for assembly. Materials which may be fabricated as a sheet or strip may be utilized as the deck or surface plate, and such includes fiberglass reinforced plastic, aluminum, plastic, and laminated or honeycomb composite panels. Also, galvanized steel may be utilized since it can be formed in a sheet, but the weight is considerably greater than the other types of materials. Since the above-identified materials can be fabricated in sheets of up to five (5) foot widths and up to and beyond forth (40) foot lengths, the as fabricated materials can be put in place by simple bolted strap-type connections or hinges or, depending on the materials involved, adhesive bonding, doweling, splining or welding.

21 Claims, 9 Drawing Sheets

FLOATABLE SYSTEM UTILIZING STRUCTURAL DECK PLATES

BACKGROUND OF THE INVENTION

The present invention relates to a floating dock or raft system, particularly to a non-skid structural plate walking surface, and more particularly to deck or plate walking surfaces, without substructure, which is attached directly to floats and other components of a dock system.

Over the years various types of floating dock and raft systems have been built, generally of wooden members supported by a substructure, which deteriorates in time due to exposure to water and weather. These prior dock and raft: systems have been composed of strips of material bolted, nailed, or welded to a substructure, all of which increases the weight. While metal materials have been utilized in many floating dock systems, metal is generally of a heavier weight than wood, and has a tendency to rust or corrode due to chemical reaction with the environment in which the dock or raft is located, as well as due to the chemical reaction with the water in which the dock or raft is floated. Also, floating docks must be movable due to the rise and fall of any wave motion of the water, as well as due to a decrease or increase of the size of the body of water to enable a continuous access from the land surrounding the water.

The present invention provides a new approach to the construction and composition of a floating dock and raft system, and is particularly concerned with reducing the overall weight and eliminating substructures. In the floating dock and raft system of the invention, a non-skid, light weight structural or deck plate walking surface, without substructures, is utilized and is directly connected (attached) to all other components of the dock system. The deck or surface walking structure is composed of interconnected lengths of material which can be fabricated to both the desired lengths and widths, thus eliminating the splicing and securing of the numerous deck or surface material strips previously utilized. The deck or surface walking structure is composed of materials compatible with the environment and the water composition in which it is floated.

SUMMARY OF THE INVENTION

It is an object of the present invention to provide a new approach to the construction of floating dock and raft systems which eliminates substructures.

A further object of the invention is to provide a non-skid structural plate or deck walking surface.

A further object of the invention is to provide a floating dock or raft system comprising sheets of deck materials without substructures, and which can be attached directly to other components of the system, such as floats, hinges, etc.

Another object of the invention is to provide lightweight, non-skid structural plate or deck material which is directly attached to floats, hinges, splice plates, slip plates, and other dock components.

Another object of the invention is to provide a floating dock system utilizing deck or surface walking material that is compatible with the environment and water composition in which the dock system is used.

Another object of the invention is to provide a floating dock system utilizing interconnected sheets of deck material, hinges and slides, whereby the dock may readily withstand the rise and fall of the water volume and rise and fall of the water surface.

Other objects and advantages of the present invention will become apparent from the following description and accompanying drawings. The present invention involves a floating dock and raft system composed of lightweight non-skid structural deck or plate walking surfaces, without substructures, which may be attached directly to dock components, such as floats, hinges, splice plates, handrails, gangway, and other miscellaneous dock structures and hardware. No substructure is required for the structural deck or plates. The deck or plate materials may be fabricated in desired widths and lengths, such as forty foot, which are compatible with current transportation regulations. The decks or plates may vary from three to six feet in width, which satisfies most floating dock applications. However, it is within the scope of this invention to use, for example, two deck or plate sheets having a width of two and one-half feet in place of a single five foot wide sheet, or two plates three feet wide in place of a six foot wide plate. The deck or plate materials may be composed, for example, of fiberglass reinforced plastic, aluminum, plastic, and laminated or honeycomb composite panels. Also, galvanized steel plates may be utilized, but due to increased weight, additional floats would be required to maintain the above-water height of the lighter weight materials. These deck or plate materials must have the strength and stiffness required to meet acceptable design standards for docks. The floating dock of the present invention utilizes hinged splice plates, for example, which can be directly connected to the deck or plate materials. Also, U-shaped rub rails are secured to the edges of the deck or plate materials. However, exposed edges of the plate or deck materials may have an optional molded, formed, or attached skirt. The spacing of the floats will vary depending on the thickness and composition of the plates or deck materials so that load carrying requirements and usage of the dock system can be met. The components of the dock or float system of the present invention requires minimal assembly, and the assembly can be carried out by unskilled labor with minimal tools. The plates can be made/molded with any width and length, either at the job site or as transportable. Certain of the plates, such as fiberglass reinforced plastic, are commercially produced 10 feet wide and 40 feet long.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

Figure 1:
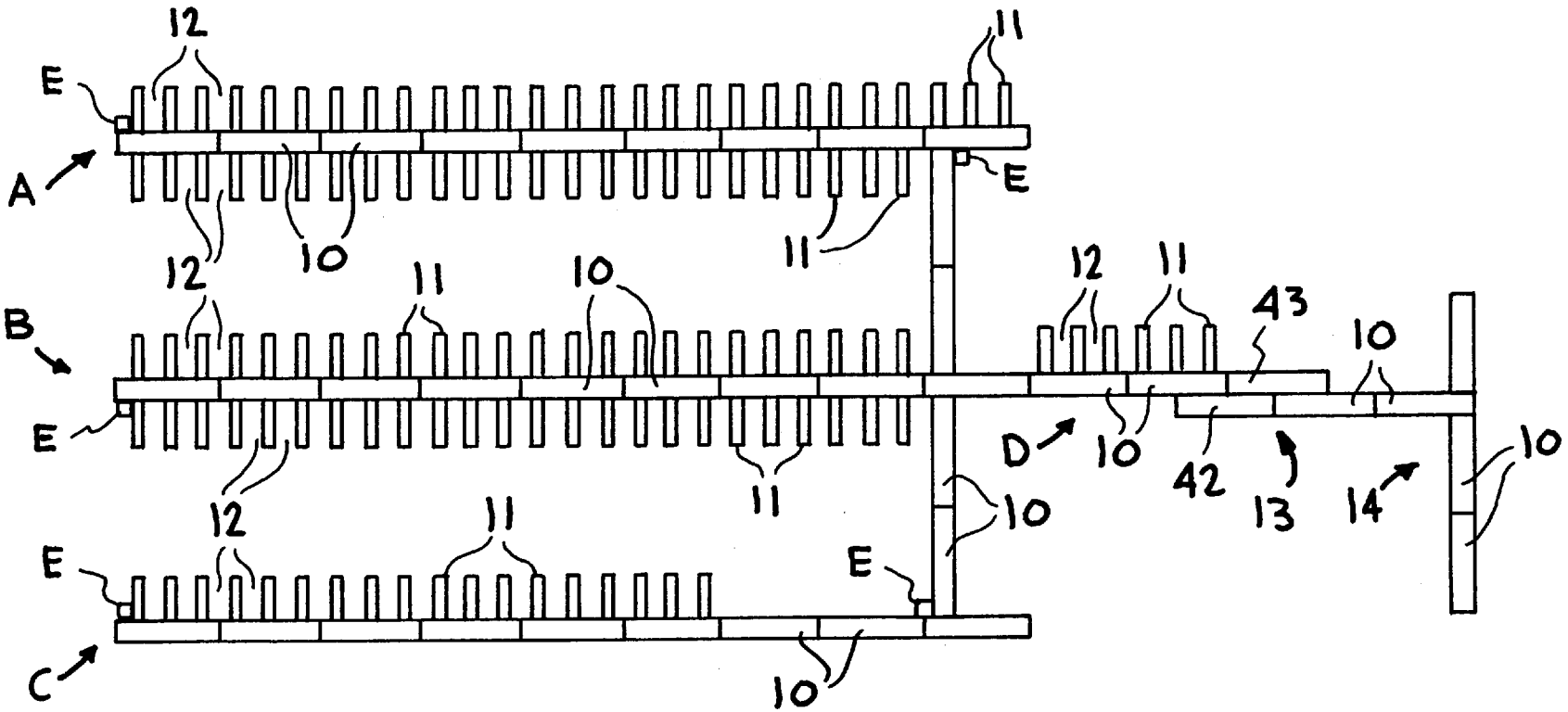
FIG. 1 is a plan view of an embodiment of a floating dock composed of a number of interconnected deck members or surface plates made in accordance with the present invention.

The present invention is directed to a floating dock and raft system utilizing non-skid structural deck members or plate walking surfaces, without substructure, and which are attached directly to all other components of the dock or float systems. Components of the floating dock system to which the decks or plates may be attached include floats, hinges, splice plates, winches, cleats, hoop pile holders and guides, ladders, wheels, handrails, roof structures, gangways, and other miscellaneous hardware. U-shaped rub rails, such as soft PVC-type members, are attached to edges of the deck members or surface plates with screws and/or adhesive. The floating dock also includes an expansion/contraction section which allows for the change in the water depth whereby the floating dock can be moved outwardly from or inwardly toward the shoreline to accommodate such water depth changes. The raft system, like the dock system, utilizes deck members or surface plates which may have a length of 40 feet and a width of 3–6 feet, for example, secured directly to floats.

The dock and raft surface plates or deck members (hereinafter termed deck plates) are structurally self-supporting without the aid or requirement for a supporting substructure, such as channels, joists, beams, etc. The deck plates must possess material properties which are capable of resisting the forces and effects of wind, wave action, sun, water, boat strikes and normal usage depending on application and location. The composition of the deck plates must be capable of withstanding corrosion or rust due to chemical reaction with the water and/or environmental conditions. The deck plate material, when used with floats and hardware as a complete system, must have the strength and stiffness to met accepted design standards for docks, which includes the capability of resisting tear-out of fasteners used for assembly of the dock components. The composition of the deck plates will effect the number and location of supporting floats to assure the required strength and stiffness is obtained.

Typical materials, currently commercially available, for the deck plates include fiberglass reinforced plastic, aluminum, plastic, and laminated composite panels or honeycomb composite material. Also, galvanized steel may be utilized but is heavier than the other material. Thus materials may be fabricated in a variety of lengths, widths and thicknesses, and can be manufactured by varying processes, such as pultrusion or contact molding for fiber reinforced plastic, extrusion for aluminum or plastic, hot rolled for steel, and various laminating processes for composite panels. All of these materials can be produced in long, wide plates with size limitations dictated by transportation or on-site molding capabilities. When the deck plates are required in larger sizes, they may be molded on site or they can be jointed with available methods, such as adhesive bonding, splining, doweling, welding, hinges or bolted strap-type connections. Excessive floatation would be required for heavier materials, such as steel, but depending on dock or raft usage this may be acceptable. Stiff, lightweight deck plates with resistance to fastener tear-out are more acceptable. For example, a deck plate constructed of fiberglass reinforced plastic or aluminum, having a thickness of ⅝ to 1 inch, can be manufactured in lengths of up to 40 foot and widths of 3 to 6 foot, and with a floatation device positioned three feet apart will meet the above-referenced strength and stiffness standards. Required thickness of deck plate and spacing of floats may vary depending on material, load carrying requirements and usage of the system. Exposed edges of the deck plates may have optional molded, formed or attached skirts. As pointed out above, rub rails may also be attached to the edges of the deck plates.

Means of attaching deck plates to all other dock components may be by carriage bolts or similar semi-flush or recessed fasteners, by threaded inserts, by welding, or by adhesives, depending on material types to be connected and the strength requirements of the connection.

Benefits of the deck plate floating dock and raft systems are as follows:

1. Minimal assembly required.
2. Assembly can be performed by unskilled labor with minimal tools for many configurations, and basically requires measuring, drilling, bolting and screwing, or bonding by adhesives.
3. No support structure required. All floats and hardware attached directly to the deck plates.
4. Decreased weight and less floatation required, except for galvanized steel.
5. Low maintenance materials.
6. Reduced assembly and maintenance costs.
7. Modular layout and assembly.
8. Will not warp or dryrot.
9. Materials can be chemically resistive or UV resistant for corrosive applications.

The basic floating dock or raft system of the present invention, as illustrated in the drawings and described in greater detail hereinafter, is composed of the following system components:

1. Deck plates of lengths up to 40 foot and widths of up to 6 foot or wider of selected materials.
2. Expanded foam floats encapsulated in plastic shells with bolting flanges, or open foam floats with bracket straps for bolt attachment. Open foam floats can also be bonded with adhesive to the bottom of the deck plates. Open foam floats, though less expensive than encapsulated floats, are not the best option as they can break apart when hit and are subject to attack by gasoline, and thus may not be accepted in some waterways. Other types of floats, such as drums, pontoons, etc. of different materials, are also available and can be manufactured for or adapted to the deck plate dock system.
3. Male/female hinge assemblies, flat splice plates, angles, channels, etc. of various materials.
4. Dock components, including winches or pile hoops, cleats, PVC rub rails, bolts and screws.

Referring now to the drawings, FIG. 1 illustrates a floating dock system for a large marina having boat docking sections secured to wood or metal piles driven into the ground, with numerous boat docking locations or slips, and incorporates the deck plate assembly and interconnections and the expansion (low water/high water) system discussed above. The dock, illustrated in FIG. 1, is basically three legs or main walkways indicated at A, B and C, each walkway composed of a number of longitudinally extending interconnected deck plates 10 and deck fingers 11 connected endwise to the deck plates 10. The walkways or legs A, B and C are interconnected to a common walkway D. The deck fingers 11 are constructed of material similar to that of the deck plates 10. For example, the deck plates 10, in this embodiment, have a length of 39 feet and width of 5 feet, with the deck fingers having a length of 20 feet and width of 3 feet, and are spaced 10 feet apart to form boat slips 12 therebetween. The floating dock of FIG. 1 also includes an expandable/contractible assembly generally indicated at 13, shown in detail in FIG. 12, and an unfloated or beached moorage assembly generally indicated at 14 which is located on the shoreline. The walkways A, B and C may be retained in place via a plurality of piles, indicated at E, which are driven into the ground, with the number of piles being determined by the location of the dock system, such as 40–60 feet apart.

It is to be understood that the floating dock system can be utilized for any number of boat slips from one to several hundred, with or without the expandable/contractible assembly.

Figure 2:
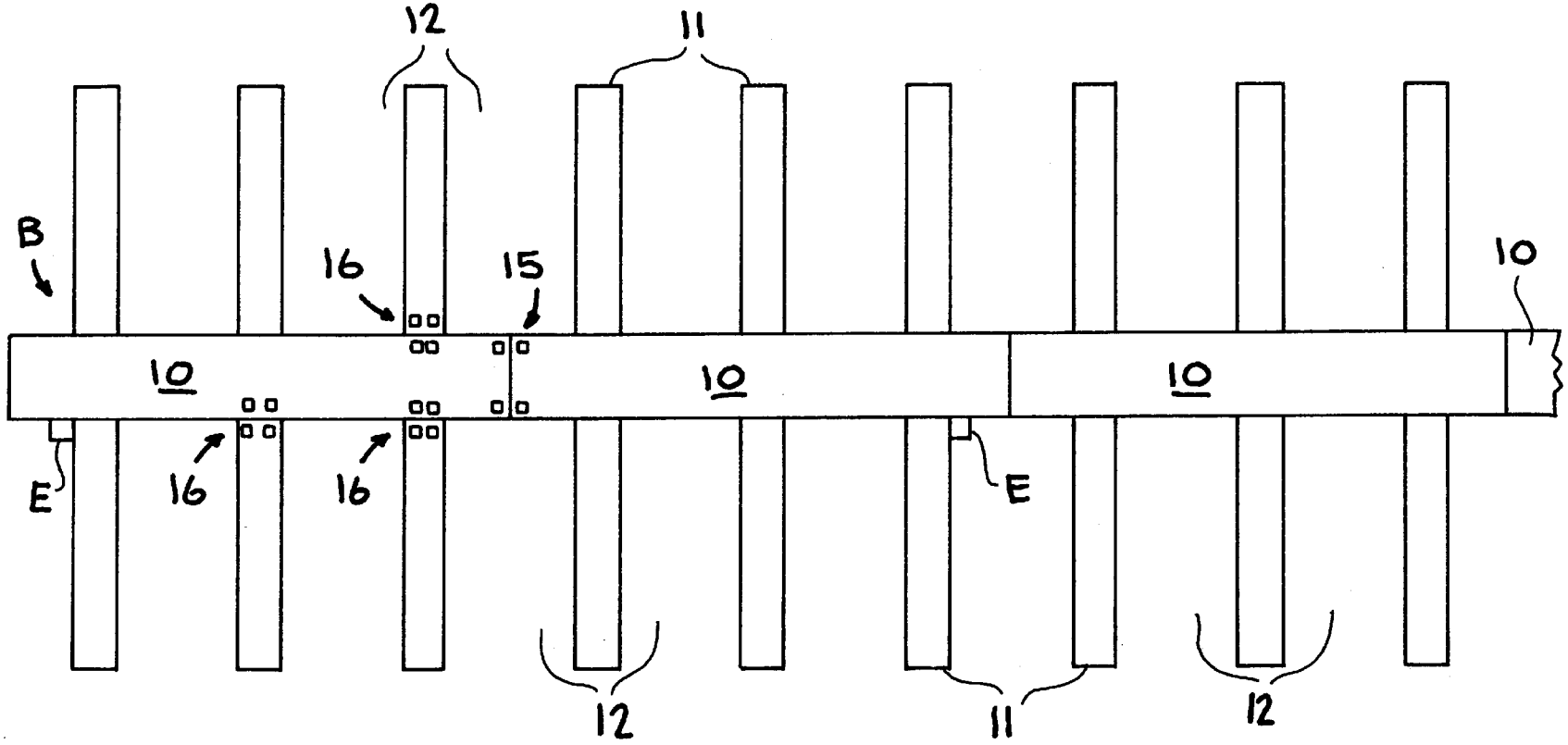
FIG. 2 is an enlarged section of the floating dock of FIG. 1.
Figure 10:
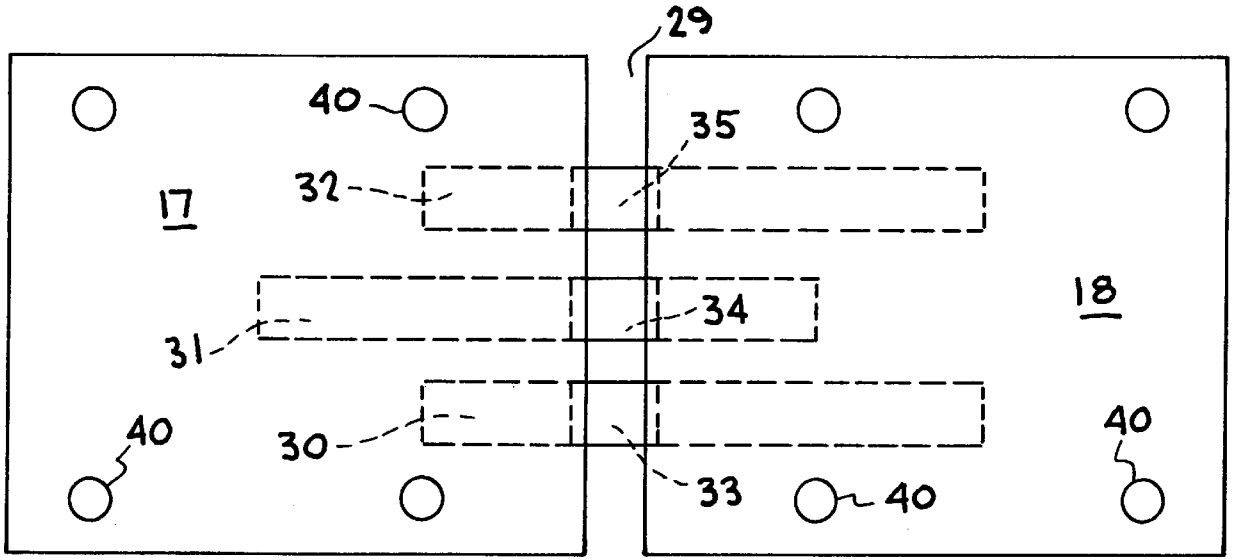
FIGS. 10 and 11 illustrate top and side views of a hinge arrangement for the FIG. 2 floating dock section.
Figure 11:
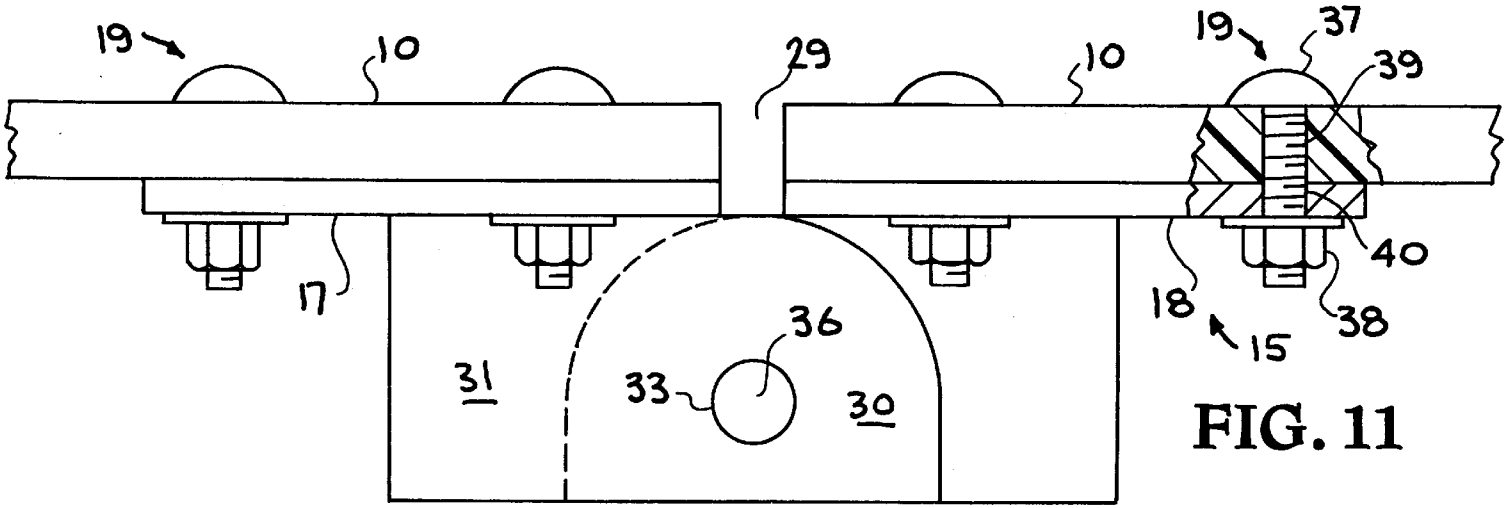

FIG. 2 is an enlarged view of a section of the FIG. 1 float dock, such as the outer end of the central leg of the FIG. 1 embodiment. As shown, this section comprises four (4) deck plates 10 interconnected end to end, with three (3) deck fingers 11 connected to each deck plate 10. For example, if a deck plate 10 is 39 feet long, and the deck fingers 11 are 20 feet long and 3 feet wide, each deck plate accommodates six (6) boat slips. The deck plates 10 are connected by a hinge assembly generally indicated at 15 (only one shown), such as illustrated in FIGS. 10 and 11, and each deck finger 11 is connected to a deck plate 10 via hinge assemblies 16 (only three shown) which also may be constructed as shown in FIGS. 10 and 11. The hinged interconnections of deck plate to deck plate and fingers to deck plates allow for relative movement therebetween caused by wave motion of the water. However, if desired to reduce costs, or if the dock system is small and/or not subjected to wave motion, the interconnections between deck plates and between fingers and deck plates may be made by bolted flat plates.

Figure 3:
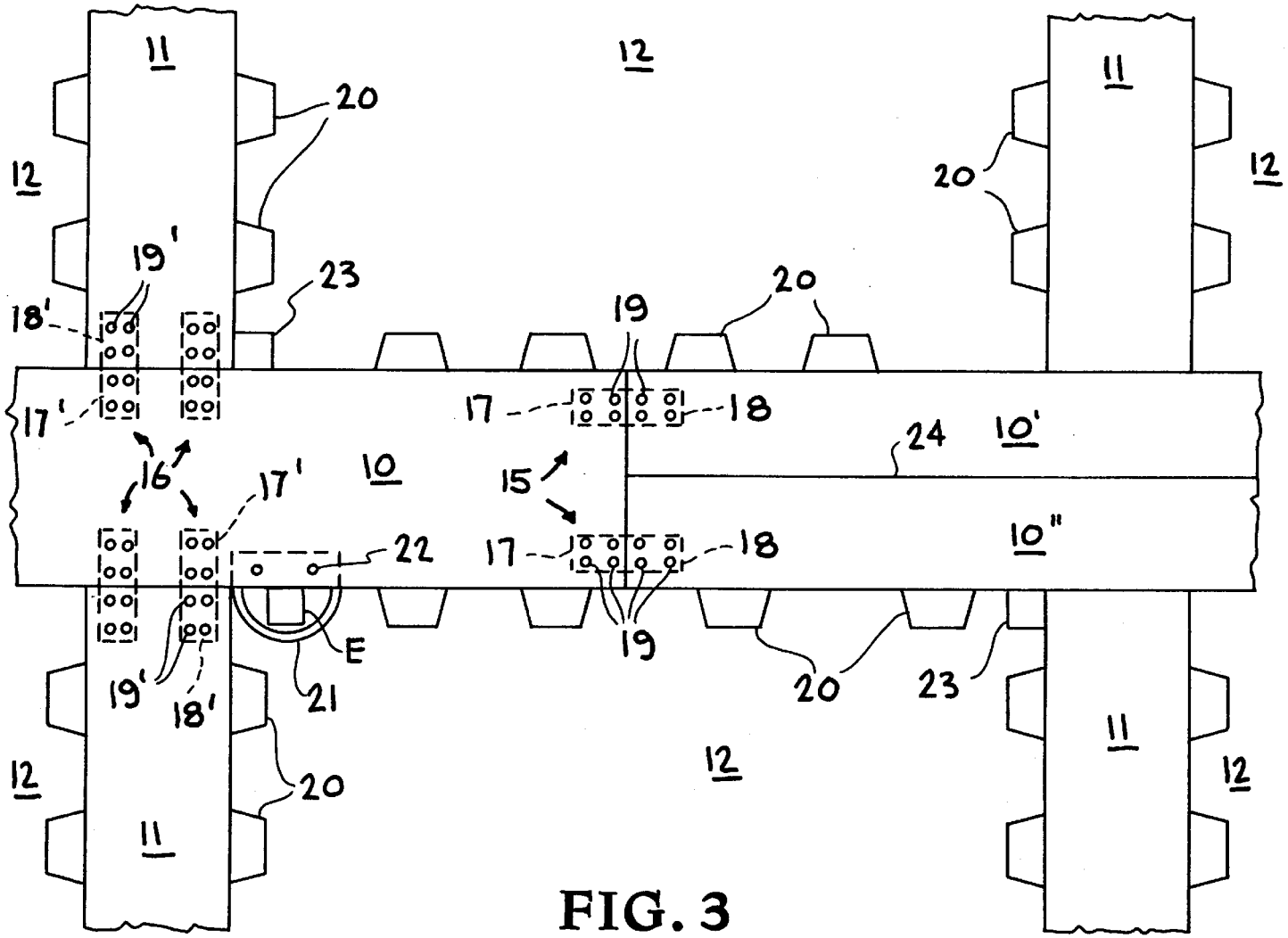
FIG. 3 illustrates a greatly enlarged interconnecting of the individual sections of the floating dock section of FIG. 2.

FIG. 3 illustrates an enlarged view of the section of FIG. 2 showing the hinge assembly interconnections 15 and 16, and the location of floats attached to the deck plates 10 and deck fingers 11. The deck plate to deck plate hinge assemblies 15 include two flat plates 17 and 18, each secured to deck plates 10 by bolts 19 (four in each flat plate). As shown by dash lines, flat plates 17 and 18 are located on the underside of deck plates 10 seen in FIG. 11. The finger to deck plate hinge assemblies 16 are constructed as hinge assemblies 15 with flat plates 17' and 18' secured to the underside of the deck fingers 11 and deck plates 10 by bolts 19' in the manner shown in FIG. 10. Each of deck plates 10 and deck fingers 11 are provided with a plurality of floats 20, each secured in spaced relation to the underside of the deck fingers and the deck plates, as described hereinafter with respect to FIGS. 4–6 and 7–9, and located 3 feet apart, for example. A hoop pile holder 21 (only one shown) is secured to the underside of deck plate 10 by bolts 22, and extends around a pile E. In addition, winch assemblies to assist in pulling the boat into the slip 12, indicated at 23, or other boat tiedown equipment, may be secured to the deck plate. In place of hoop pile holders 21, cable winches with bottom anchors may be utilized where surface elevation of the water varies more than can be accommodated by driven piles of a reasonable length.

If desired, the deck plates 10 of FIGS. 2 and 3 may be constructed of two parts, such as two 2 foot 6 inch, or two 3 foot wide deck plates, as partially indicated at 10' and 10" in FIG. 3 by line 24 which are splined or dowled together to form the desired 5–6 foot width.

Figure 4:
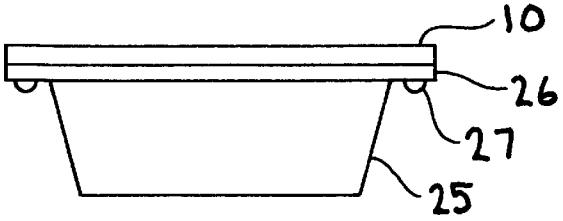
FIGS. 4, 5 and 6 illustrate enlarged end, top and side views of a single floating dock section with a float arrangement secured thereto.
Figure 5:
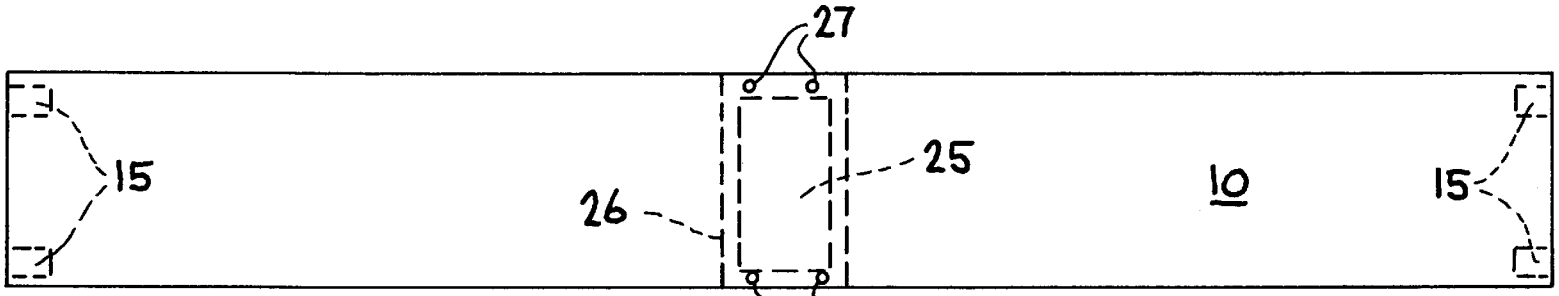
Figure 6:
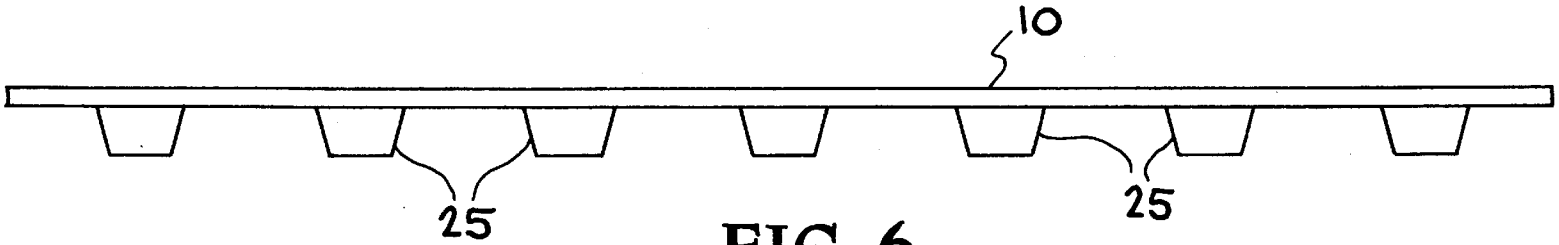

FIGS. 4–6 illustrate an embodiment of a float assembly secured to the underside of the deck plates via a bolted flange. As shown, a deck plate 10 is 39 feet long, hinged at 15 at each end, is provided with a plurality of float assemblies 25, each having attachment flanges 26 which are secured to the deck plate 10 by bolts or screws 27 which may terminate within the deck plate 10, as shown, or may constitute a bolt and nut assembly, as in FIG. 11, which extends through the deck plate 10 and flange 26 of float assemblies 25. The float assemblies 25 may, if desired, include tapered side walls. As shown in FIG. 6, the float assemblies 25 are equally spaced along the length of deck plate 10, a separation distance, for example, of 3 feet. Depending on the materials of the deck plates and the desired load therein, the float assemblies may be spaced closer or further apart. As described above, the float assemblies 25 may be of the encapsulated type or open type, depending on the application. For example, the floats 25 have a height of 20 inches, length of 4 feet and width of 2 feet.

Figure 7:
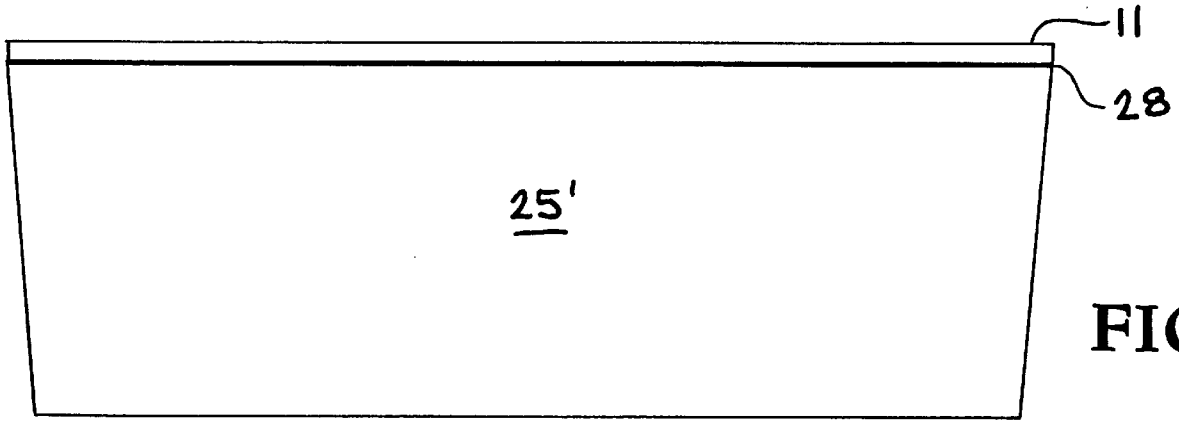
FIG. 7 is an enlarged end view of a float arrangement for a deck finger or raft section.
Figure 8:
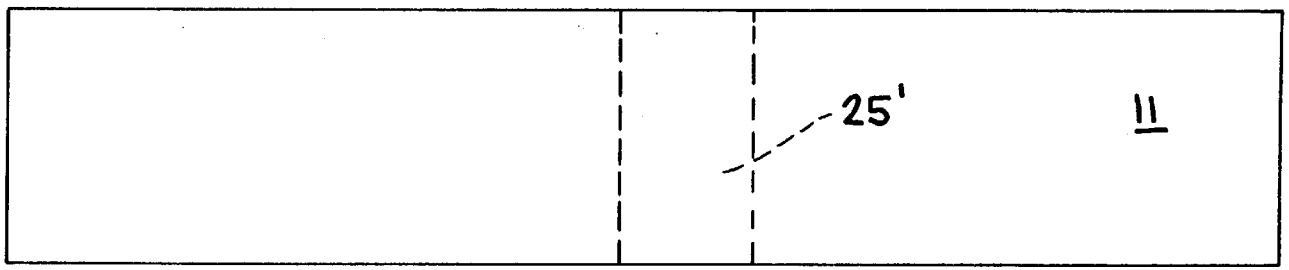
FIGS. 8 and 9 illustrate top and end views of the floating finger section using the float arrangement of FIG. 7.
Figure 9:
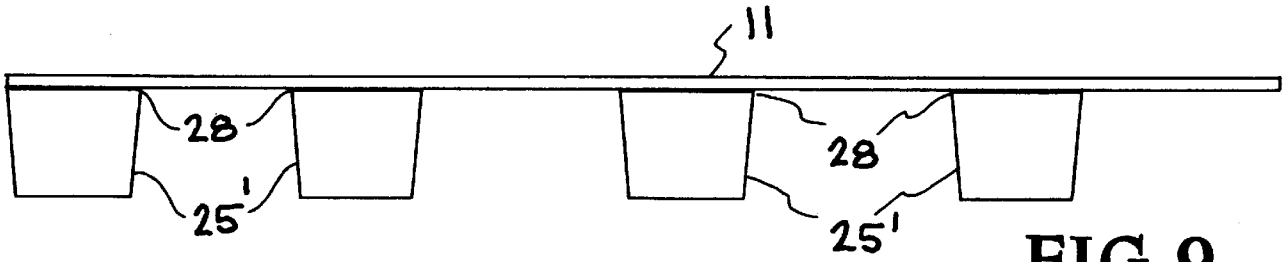

FIGS. 7–9 illustrate a finger plate/float assembly, which is utilized on the fingers 11 of the floating dock system as shown in FIG. 1. Note that the right end of finger 11 has no float assembly since it connects to a deck plate 10 via a hinged or non-hinged arrangement. In this finger float assembly embodiment, the floats 25' include float flanges which are recessed and do not extend past the edge of the floats, as in FIGS. 4–6. The floats 25' are secured directly to the underside of the deck plate 10 as indicated at 28 by bolts, adhesive bonding, welding, etc., depending on the materials of the deck plate 10 and the float 25'. Also, the floats 25' of FIGS. 7–9 may be smaller or larger than float assemblies 25 of FIGS. 4–6, and thus a greater or fewer number of floats may be required to maintain the same weight load. For example, the floats 25' may have a depth of 12–20 inches, a length of 3–8 feet and width of 1–4 feet.

FIGS. 10 and 11 illustrate an embodiment of a metal hinge assembly, such as hinge assemblies 15 and 16 of FIG. 3. The hinge assembly 15 (or 16) as shown in FIGS. 10 and 11 include a pair of flat plates 17 and 18 secured to adjacent ends of deck plates 10 by bolts 19, such that a space 29 therebetween allows for relative movement of the deck plates 10. The hinge assembly also includes three members 30, 31 and 32 having openings 33, 34 and 35 respectively, through which a pivot. pin 36 extends. As shown in FIG. 11, members 30 and 32 are attached to plate 18 and member 31 is attached to plate, as by welding. As shown in FIG. 11, the bolts 19 comprise carriage bolts heaving semi-flat head 37 and a nut 38, and extend through openings 39 in the deck plates 10 and openings 40 in the flat plates 18 and 17. Thus, as one of the deck plates 10 is moved by water motion or a load placed thereon, it can pivot about the pin 36 relative to the adjacent deck plate due to members 30–32 being secured to flat plates 17 and 18. If the deck plates 10 are constructed of a metal, the flat plates 17 and 18 can be welded thereto, thus eliminating the bolts 19.

Figure 12:
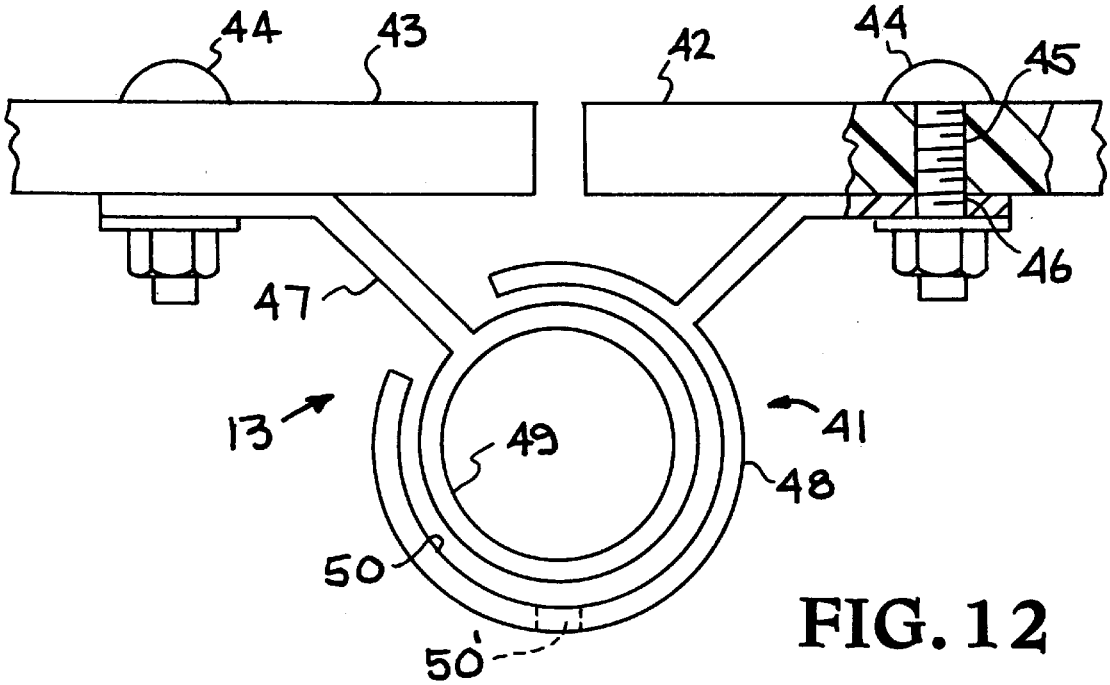
FIG. 12 illustrates a side view of an expandable section of the FIG. 1 embodiment.

FIG. 12 illustrates an embodiment of the expandable/contractible section 13 of the floating dock system of FIG. 1. As shown, a metal slide channel is attached, as by bolting or welding, to adjacent deck plates which are positioned side by side, as shown in FIG. 1. As shown, a metal slide channel 41 is secured to two side-by-side deck plates indicated at 42 and 43 via bolts 44 which extend through openings 45 and 46 in the slide channel and deck plates, and bolts 44 may be of the carriage type described above in FIG. 11. The slide channel 41 comprises two cooperating members 47 and 48, with member 47 having an annular or cylindrical end section 49, and with member 48 having an annular or cylindrical opening section 50 within which the end section 49 of member 47 moves. Thus, as the plate decks 42 and 43 move relative to each other, the section 49 of member 47 moves within the opening section 50 of member 48, whereby the floating dock can move relative to the moorage assembly 14 of the FIG. 1 embodiment. Section 50 of member 48 includes weep holes or openings 50' to allow drainage (only one shown).

Figure 13:
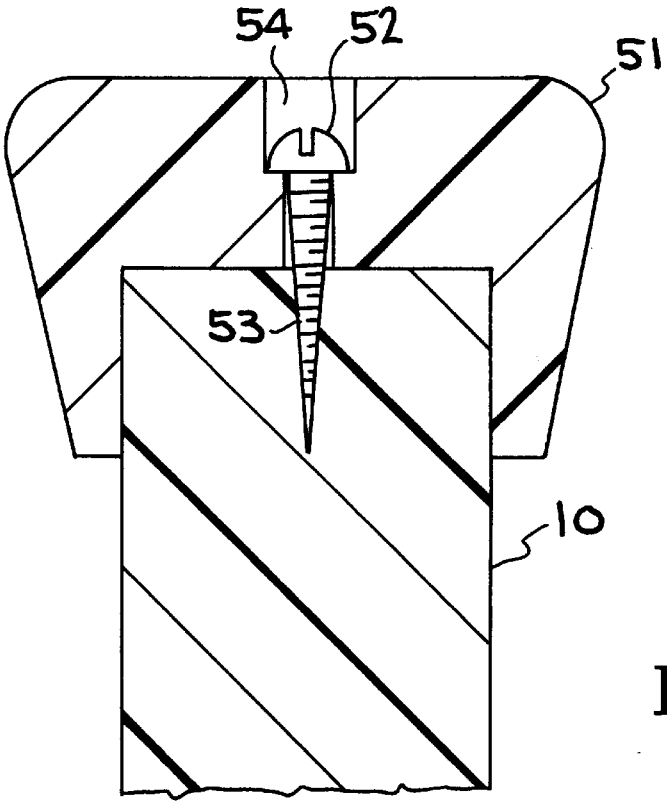
FIG. 13 illustrates a cross-section of an embodiment of a U-shaped rub rail attached to an edge of a deck member or plate of the FIG. 1 embodiment.

FIG. 13 illustrates a means of protecting the edges of the deck plates 10, and comprises a U-shaped member, rub rail, or bumper 51 constructed of any suitable material, such as PVC (plastic) or a flexible metal, and is secured to the deck plate 10 via a screw 52 extending through an opening 53 in member 51, with opening 53 having a counter sink (enlarged) section 54, whereby screw 52 is recessed within member 51 when fully secured to deck plate 10. The U-shaped member 51 may also be connected to deck plate 10 by adhesive bonding or spot welding, for example, depending on the composition of the member 51 and the deck plate 10.

Figure 14:
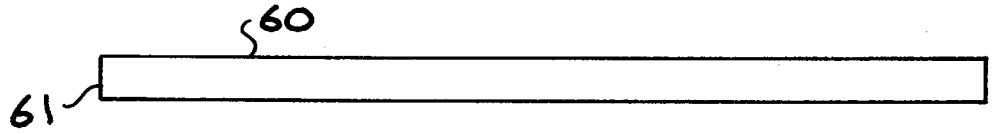
FIGS. 14–19 illustrate end views of embodiments of the plate or deck members forming the floating dock embodiment of FIG. 1.
Figure 15:
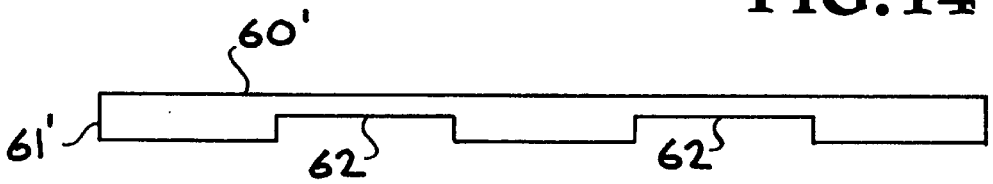
Figure 16:
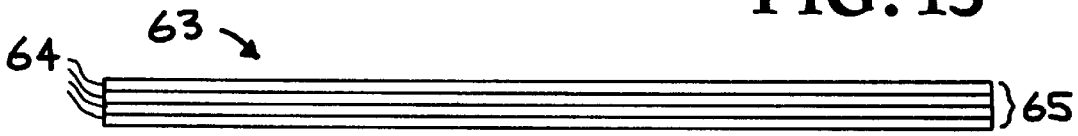
Figure 17:
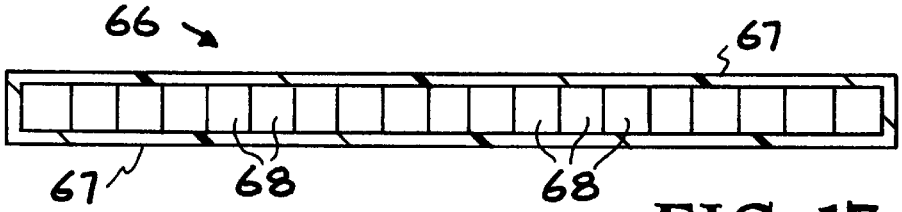
Figure 18:
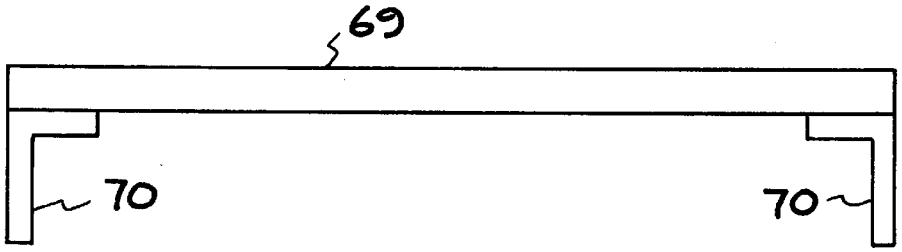
Figure 19:
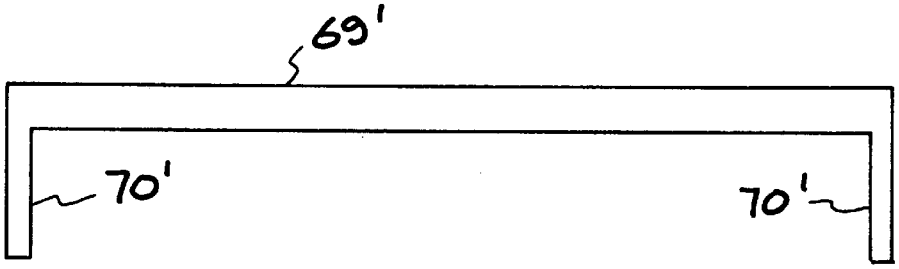

FIGS. 14–19 illustrate different cross-sections or end views of the deck plates 10 and deck fingers 11. FIG. 14 illustrates a standard or basic deck plate 60 having a uniform thickness 61. FIG. 15 illustrates a modification of the basic deck plate 60' having a thickness 61' with notched sections 62. FIG. 16 illustrates a deck plate 63 composed of laminated members 64 to form a composite thickness 65. FIG. 17 illustrates a honeycomb sandwich construction wherein the deck plate 66 comprises an outer frame 67 within which are a series of vertical members 68 forming a honeycomb FIG. 18 is a modification of the basic deck plate of FIG. 14, as indicated at 69, with skirts 70 attached thereto by adhesive bonding, bolting, etc. FIG. 19 is a modification of the FIG. 18 embodiment wherein skirts 70' are formed integral with the deck plate 69'.

Figure 22:
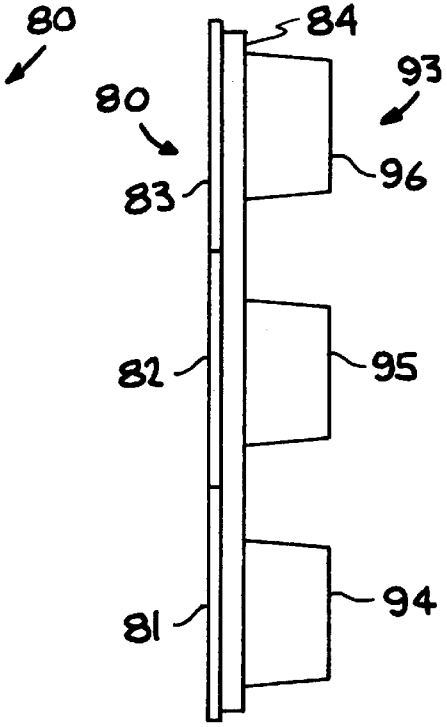
FIGS. 20, 21 and 22 illustrate top, end and side views of an embodiment of a raft system made in accordance with the present invention.
Figure 20:
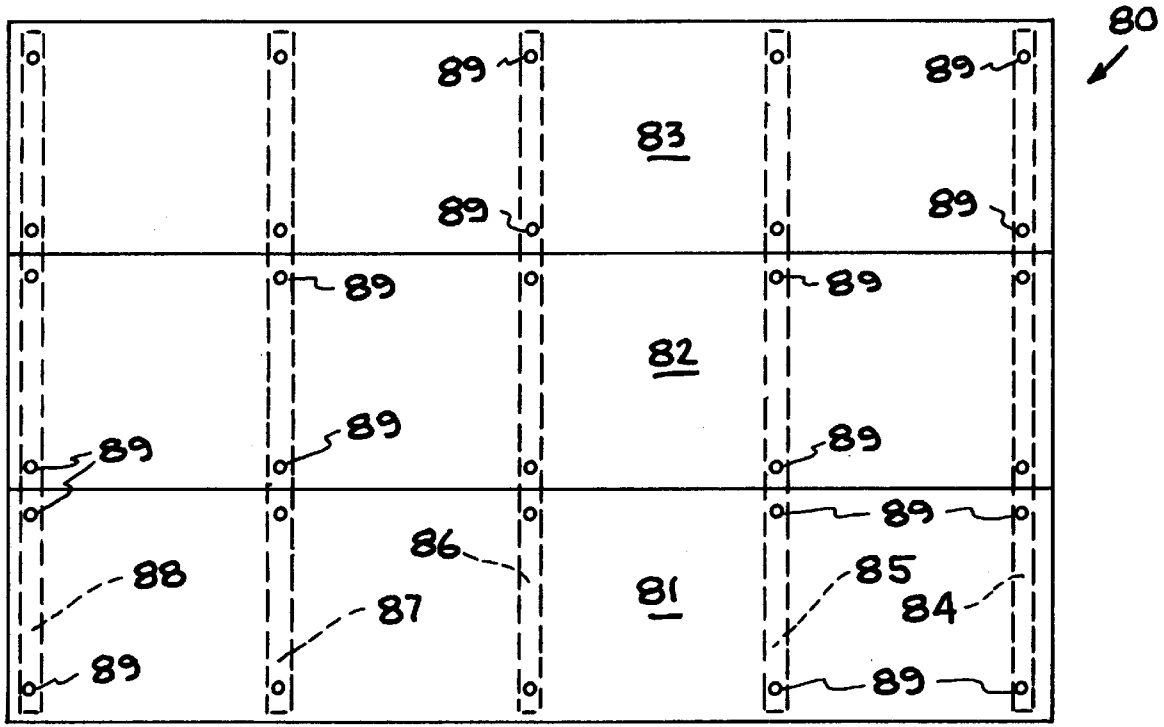
Figure 21:
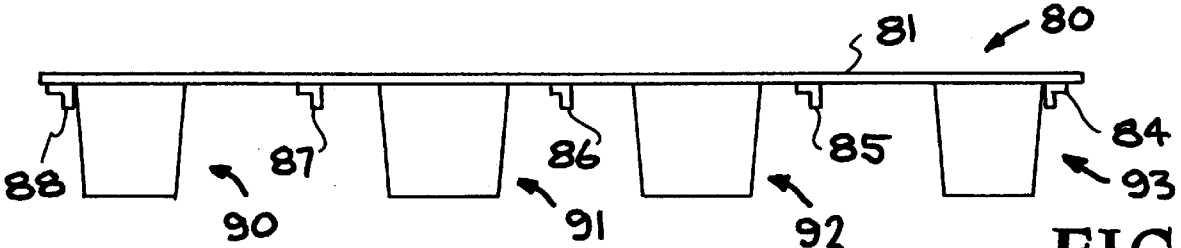

FIGS. 20–22 illustrate an embodiment of a raft system made in accordance with the present invention utilizing a plurality of interconnected longitudinally extending deck plates supported by a plurality of floats. As shown, the raft system, generally indicated at 80, includes three (3) deck plates 81, 82 and 83, and interconnected angle or channel metal or composite strips 84, 85, 86, 87 and 88 utilizing two bolts 89 on each deck plate. Four float assemblies, generally indicated at 90, 91, 92 and 93, of three (3) floats each, indicated at 94, 95 and 96, are mounted beneath (on the underside) of each of deck plates 81, 82 and 83. The float assemblies 90–93 may be of the type illustrated in FIGS. 4–6 or FIGS. 7–9, and connected to the deck plates as described above. The width and length of the raft system 80 are each limited only by the transport method, unless that system is disassembled for transport and reassembled at the point of use. The raft of FIG. 20 may also be constructed with only one large deck plate, since the deck plate material can be currently fabricated in widths in excess of 10 foot.

It has thus been shown that the present invention provides a floating dock or raft system composed of interconnected deck plates and interconnected deck fingers, without a substructure, for the dock system. The deck plates and deck fingers are supported by float assemblies, of either an encapsulated or open type, which may be bolted or otherwise secured together. The deck plates and the deck fingers are interconnected by hinge assemblies which enable relative movement thereof. Also, the dock system includes an expandable/contractible section secured to a moving section which accommodates the rise or fall of the water body in which the dock system is located. In addition, the edges of the deck plates are protected by a rub rail or bumper. The components of the floating dock or raft systems are readily assembled or disassembled, and the lengths and widths of the deck plates, for example, are controlled by manufacturing capabilities and transportation limitations. The deck plates and deck fingers can be manufactured in many widths and lengths, and may be produced on site, if necessary.

While particular embodiments, materials, parameters, etc. have been described and/or illustrated, such are not intended to be limiting. Modifications and changes may become apparent to those skilled in the art, and it is intended that the invention be limited only by the scope of the appended claims.

What is claimed is:

1. A floatable system, without deck supporting substructure, comprising:

a plurality of self-supporting interconnected longitudinally extending deck plates without supporting substructure, and a plurality of float assemblies mounted in spaced relation to each of said deck plates.

2. The floatable system of claim 1, wherein said plurality of deck plates are interconnected side-by-side to form a raft system.

3. The floatable system of claim 2, wherein said plurality of deck plates are interconnected by a plurality of members secured to each of said deck plates.

4. The floatable system of claim 3, wherein said plurality of float assemblies are selected from a group consisting of open floats and encapsulated floats.

5. The floatable system of claim 4, wherein said plurality of float assemblies are mounted to said plurality of deck plates by either a bolted or non-bolted mounting means.

6. The floatable system of claim 5, wherein each of said plurality of longitudinally extending deck plates have a non-skid surface, a width of about 2–6 feet, and length of up to about 40 feet.

7. The floatable system of claim 1, wherein said plurality of interconnected longitudinally extending deck plates are connected to form a boat docking section and are connected to one another by at least one end of each deck plate, and additionally including a plurality of deck fingers, each connected at one end in spaced relation to a deck plate to form at least one boat slip.

8. The floatable system of claim 7 wherein each boat slip includes means for tying a boat to the floatable system.

9. The floatable system of claim 7, additionally including an expandable/contractible section connected to an moorage section.

10. The floatable system of claim 9, wherein said expandable/contractible section includes a plurality of longitudinally extending deck plates mounted in a side-by-side arrangement and including means connected to each side-by-side deck plate which allows one of said deck plates to move longitudinally with respect to another of said deck plates.

11. The floatable system of claim 10, wherein said means comprises at least one pair of members with one of said pair of members mounted to each side-by-side deck plate, said pair of members being constructed to allow a section of one member to move within a section of the other member, whereby said deck plates can move longitudinally with respect to one another.

12. The floatable system of claim 7, wherein at least one adjacent pair of deck plates are interconnected by a hinge assembly.

13. The floatable system of claim 12, wherein said hinge assembly comprises a pair of flat plates adapted to be secured to adjacent sections of said pair of deck plates, and a plurality of pivotal members each secured to one of said flat plates and mounted on a pin, whereby one deck plate can pivot with respect to the adjacent deck plate.

14. The floatable system of claim 13, wherein said pair of flat plates are secured to adjacent sections of said pair of deck plates by a technique selected from the group consisting of bolting, welding, and adhesive bonding.

15. The floatable system of claim 7, wherein at least a portion of said deck fingers are attached to said deck plates by a hinge assembly, whereby the deck fingers can pivot with respect to the deck plate.

16. The floatable system of claim 7, wherein each of said deck plates is constructed of a single piece of material.

17. The floatable system of claim 16, wherein each of said deck plates have a non-skid surface, width of about 5–6 feet and a length of not greater than 40 feet, and wherein each of said deck fingers have a width of 3–4 feet and a length of about 20 feet.

18. The floatable system of claim 16, wherein said deck plates are constructed of material selected from the group consisting of fiberglass reinforced plastic,aluminum, plastic, laminated panels, honeycomb composite material, and galvanized steel.

19. The floatable system of claim 16, wherein each of said deck fingers are constructed of a single piece of material having a non-skid surface and selected from the group consisting of fiberglass reinforced plastic, aluminum, plastic, laminated or honeycomb materials, and galvanized steel.

20. The floatable system of claim 7, wherein said float assemblies are selected from the group consisting of open-type and encapsulated floats.

21. A floatable system, without deck supporting substructure, comprising:

at least one self-supporting longitudinally extending deck plate without supporting substructure, said at least one deck plate being constructed of a single piece of material, and a plurality of float assemblies mounted in spaced relation to said at least one deck plate.

* * * * *